US009715953B2

(12) United States Patent
Weldon et al.

(10) Patent No.: US 9,715,953 B2
(45) Date of Patent: Jul. 25, 2017

(54) WIDEBAND NEGATIVE-PERMITTIVITY AND NEGATIVE-PERMEABILITY METAMATERIALS UTILIZING NON-FOSTER ELEMENTS

(71) Applicants: Thomas P. Weldon, Charlotte, NC (US); Ryan S. Adams, Charlotte, NC (US); Konrad Miehle, Mesa, AZ (US)

(72) Inventors: Thomas P. Weldon, Charlotte, NC (US); Ryan S. Adams, Charlotte, NC (US); Konrad Miehle, Mesa, AZ (US)

(73) Assignee: The University of North Carolina at Charlotte, Charlotte, NC (US)

( * ) Notice: Subject to any disclaimer, the term of this patent is extended or adjusted under 35 U.S.C. 154(b) by 610 days.

(21) Appl. No.: 13/766,249

(22) Filed: Feb. 13, 2013

(65) Prior Publication Data

US 2013/0207737 A1 Aug. 15, 2013

Related U.S. Application Data

(60) Provisional application No. 61/597,875, filed on Feb. 13, 2012.

(51) Int. Cl.

| | |
|---|---|
| ***H01Q 15/02*** | (2006.01) |
| ***H01B 11/00*** | (2006.01) |
| ***H01Q 15/00*** | (2006.01) |

(52) U.S. Cl.
CPC ..... *H01B 11/00* (2013.01); *H01Q 15/0086* (2013.01)

(58) Field of Classification Search
CPC .... H01B 11/00; H01Q 15/0086; H01P 1/2005
(Continued)

(56) References Cited

U.S. PATENT DOCUMENTS 6,933,812 B2 * 8/2005 Sarabandi et al. ..... 333/219
8,197,887 B1 * 6/2012 Burckel ..... 427/97.7
(Continued)

OTHER PUBLICATIONS

Poutrina, Ekaterina, Larouche, Stéphane Larouche, Smith, David R., "Parametric oscillator based on a single-layer resonant metamaterial", Optics Communications 283 (2010) 1640-1646, Center for Metamaterials and Integrated Plasmonics, Department of Electrical and Computer Engineering, Pratt School of Engineering, Duke University, Box 90291 ,Durham, NC 27708, USA, Accepted Nov. 13, 2009.

(Continued)

*Primary Examiner* — Graham Smith
(74) *Attorney, Agent, or Firm* — Clements Bernard Walker PLLC; Christopher L. Bernard

(57) ABSTRACT

A metamaterial simultaneously exhibiting a relative effective permeability and a relative effective permittivity below unity over a wide bandwidth, including: one of a two-dimensional and a three-dimensional arrangement of unit cells, wherein each of the unit cells has a magnetic dipole moment and an electric dipole moment that are dependent upon one or more of an incident magnetic field and an incident electric field; and a coupling mechanism operable for coupling one or more of the incident magnetic field and the incident electric field to one or more devices. Optionally, the coupling mechanism includes one or more of a split ring and a pair of parallel plates coupled by one of a rod and a wire. The one or more devices are non-Foster elements.

22 Claims, 9 Drawing Sheets

(58) Field of Classification Search
USPC ..... 343/909; 333/219
See application file for complete search history.

(56) References Cited

U.S. PATENT DOCUMENTS

| | | | | |
|---|---|---|---|---|
| 8,912,973 | B2 * | 12/2014 | Werner et al. | 343/853 |
| 8,976,077 | B2 * | 3/2015 | Colburn et al. | 343/909 |
| 8,988,173 | B2 * | 3/2015 | Hitko et al. | 333/260 |
| 2012/0256811 | A1 | 10/2012 | Colburn et al. | |

OTHER PUBLICATIONS

Simovski, Constantin R., and HE, Sailing, "Frequency range and explicit expressions for negative permittivity and permeability for an isotropic medium formed by a lattice of perfectly conducting Omega particles", Physics Letters A 311 (2003) 254-263, Accepted Mar. 12, 2003.

Donzelli, G., Vallecchi, A., Capolina, F., Scjuchinsky, A., "Metamaterial made of paired planar conductors: Particle resonances, phenomena and properties", Metamaterials 3 (2009) 10-27, Accepted Dec. 16, 2008.

Alu, Andrea, Engheta, Nader, "Cloaking a receiving antenna or a sensor with plasmonic metamaterials", Metamaterials 4 (2010) 153-159, Accepted Mar. 10, 1010.

Sussman-Fort, Stephen E., "Gyrator-Based Biquad Filters and Negative Impedance Converters for Microwaves" pp. 86-101, Department of Electrical Engineering, State University of New York, Stony Brook, New York 11794-2350; e-mail: sussman@sbee.sunysb.edu; revised Sep. 22, 197.

Veselago, V.G., "The Electrodynamics of Substances with Simultaneously Negative Values of Epsilon and Mu", P. N. Lebedev Physics Institute, Academy of Science, USSA, Soviet Physics Uspek, vol. 10, No. 4, Jan.-Feb. 1968, Usp. Fiz. Nauk 92, 517-526 (Jul. 1964).

Aberle, James T., Buchanan, David A., and McKinzie, William E., III, "Simulatin of ARtificial Magnetic Materials Using Lattices of Loaded Molecules", Part of the SPIE Conference on Terahertz and Gigahertz Photonics, Denver, Colorado, Jul. 1999, 188 SPIE vol. 3795.

Tretyakov, S.A., "Meta-Materials with Wideband Negative Permittivity and Permeability", Microwave and Optical Technology Letters, vol. 31, No. 3, Nov. 5, 2001.

Nguyen, Thanh Tung, Lievens, Peter, Lee, Young Pak and Vu, Dinh Lam, "Computational studies of a cut-wire pair and combined metamaterials", Advances in Natural Sciences: Nanoscience and Nanotechnology, Adv. Nat. Sci.: Nanosci. Nanotechnol. 2 (2011) 033001 (9pp).

Surakampontorn, Wanlop, "Accurate CMOS-based Current Conveyors", IEEE Transactions on Instrumentation and Measurement, vol. 40. No. 4. Aug. 1991 699.

Sedra, A.S., Roberts, G.W., Gohn, F., "The Current conveyor: history, progress and new results", IEE Proceedings, vol. 137, Pt. G., No. 2, Apr. 1990, pp. 78-87.

Popovic, Jelena, Pavasovic, Aleksandra, and Vasiljevic, Dragan, "Low-power High Bandwidth CMOS Current Conveyor", Proc 21 st International Conference on Microelectronics (MIEC97), vol. 2, NIS, Yugoslavia, Sep. 14-17, 1997.

Pendry, J. B., Holden, A. J., Robbins, D. J. Robbins, and Stewart, W. J., "Magnetism from Conductors and Enhanced Nonlinear Phenomena", IEEE Transactions on Microwave Theory and Techniques, vol. 47, No. 11, Nov. 1999, pp. 2075-2084.

Sedra, A., Smith, K.C., "A Second-Generation Current Conveyor and its Applications", IEEE Transactions on Circuit Theory, Feb. 1979, pp. 132-134.

Ziolkowski, Richard W., "Design, Fabrication, and Testing of Double Negative Metamaterials", Richard W. Ziolkowski, IEEE Transactions on Antennas and Propagation, vol. 51, No. 7, Jul. 2003, pp. 1516-1529.

Tretyakov, Sergei A., Maslovski, Stanislav, and Belov, Pavel A., "An Analytical Model of Metamaterials Based on Loaded Wire Dipoles", IEEE Transactions on Antennas and Propagation, vol. 51, No. 10, Oct. 2003, pp. 2652-2658.

Falcon, Francisco, Lopetegi,Txema, Baena, Juan D., Marques, Ricardo, Martin, Ferran, and Sorolla, Mario, "Effective Negative-Stopband Microstrip Lines Based on Complementary Split Ring Resonators", IEEE Microwave and Wireless Components Letters, vol. 14, No. 6, Jun. 2004, pp. 280-282.

Lai, Anthony, Caloz, Christophe, and Itoh, Tatsuo, "Composite Right/Left-Handed Transmission Line Metamaterials", IEEE Microwave Magazine, Sep. 2004, pp. 34-50.

Sato, Takahide, Tagagi, Shigetaka, Fugii, Nobuo, Hashimoto, Yasuyuki, Sakato, Kohji and Okada, Hiroyuki, "4-Gb/a Track and Hold Circuit using Parasitic Capacitance Canceller", 2004 IEEE, pp. 347-350.

Smith, K.C., Sedra, A., "The Current Conveyor—A New Circuit Building Block", Proceedings of the IEEE, Aug. 1968, pp. 1368-1369.

Linvill, J.G., "Transistor Negative-Impedance Converters", Proceedings of the I.R.E., pp. 725-729.

Mosallaei, Hossein and Sarabandi, Kamal, "Design and Modeling of Patch Antenna Printed on Magneto-Dielectric Embedded-Circuit Metasubstrate", IEEE Transactions on Antennas and Propagation, vol. 55, No. 1, Jan. 2007, pp. 45-52.

Tretyakov, S.A., and Maslovski, S.I., "Veselago Materials: What is Possible and Impossible about the Dispersion of the Constitutive Parameters", IEEE Antennas and Propagation Magazine, vol. 49, No. 1, Feb. 2007, pp. 37-43.

Yoo, Kwisung, Lee, Dongmyung, Han, Gunhee, Park, Sung Min and Oh, Won Seok, "A 1.2V 5.2mW 40dB 2.5Gb/a Limiting Amplifier in 0.18 CMOS Using Negative-Impedance Compensation", 2007 IEEE International Solid-State Circuits Conference, ISSCC 2007/Session 2/ Optical Communications/ 2.8, pp. 56-57.

Zhu, Cheng, Ma, Jing-Jing, Li, Long and Liang, Chang-Hong, "Multiresonant Metamaterial Based on Asymmetric Triangular Electromagnetic Resonators", IEEE Antennas and Wireless Propagation Letters, vol. 9, 2010, pp. 99-102.

Szabo, Zsolt, Park, Gi-Ho, Hedge, Ravi, and Li, Er-Ping, "A Unique Extraction of Metamaterial Parameters Based on Kramers-Kronig Relationship", IEEE Transactions on Microwave Theory and Techniques, vol. 58, No. 10, Oct. 2010, pp. 2646-2653.

Rozanov, Konstantin N., Koledintseva, Marina Y., and Drewniak, James L., "A New Mixing Rule for Predicting of Frequencey-Dependent Material Parameters of Composites", 2010 URSI International Symposium of Electromagnetic Theory, pp. 584-587.

Weldon, Thomas P., Adama, Ryan S. and Mulagada, Raghu K., "A Novel Unit Cell and Analysis for Epsilon Negative Metamaterial", 2011 IEEE, pp. 211-214.

Saha, Arum Kumar, "Effective Permittivity of Artificial Material Composed of Metal Particles—A Generalized Picture", 2011 IEEE, pp. 215-219.

Ugarte-Munoz, Eduardo, Hrabar, Silvio and Segovia-Vargas, Daniel, "Investigation of Stability of Negative Impedances for Use in Active Metamaterials and Antennas", Proceedings of the 5th European Conference on Antennas and Propagation (EUCAP), pp. 2059-2063.

Hrabar, S., Krois, I., Bonie, I., and Kiricenko, A., "Non-Foster Elements—New Path Towards Broadband ENZ and MNZ Metamaterials", EuCAP 2011—Convened Papers, pp. 2674-2677.

Sterns, Stephen D., "Non-Foster Circuits and Stability Theory", 2011 IEEE, pp. 1942-1945.

Kim, Dong-Jin, and Lee, Jeong-Hae, "Broadband Left-Handed Waveguide with Double L-Shaped Short Stubs and E-plane Posts", 2011 IEEE, pp. 2958-2968.

White, Carson R., May, Jason W., and Colburn, Joseph S., "A Variable Negative-inductance Integrated Circuit at UHF Frequencies", IEEE Microwave and Wireless Components Letters, vol. 22, No. 1, Jan. 2012, pp. 35-37.

Gregorie, Daniel J., White, Carson R., and Colburn, Joseph S., "Wideband Artificial Magnetic Conductors Loaded With Non-Foster Negative Inductors", IEEE Antennas and Wireless Propagation Letters, vol. 10, 2011, pp. 1586-1589.

(56) References Cited

OTHER PUBLICATIONS

Weldon, Thomas P., Miehle, Konrad, Adams, Ryan S. and Daneshvar, Kasra, Simulation, Measurement, and Parameter Extraction for a 5.8 GHz Negative Permittivity Metamaterial, 2012 IEEE.
Weldon, Thomas P., Miehle, Konrad, Adams, Ryan S. and Daneshvar, Kasra, "A Wideband Microwave Double-Negative Metamaterial with Non-Foster Loading", 2012 IEEE.
Mrkovic, Bosko, and Asenbrenser, Martina, "The Simple CMOS negative capacitance with improved frequency response", MIPRO 2012, May 21-25, 2012, Opatija, Croatia, pp. 87-90.
Miehle, Konrad, Weldon, Thomas, P., Adams, Ryan S. and Daneshvar, Kasra, "Wideband Negative Permeability Metamaterial with Non-Foster Compensation of Parasitic Capacitance", 2012 IEEE.
Schurig, D., Mock, J.J., and Smith, D.R., "Electric-field-coupled resonators for negative permittivity metamaterials", Applied Physics Letters 88, 041109 (2006).
Barroso, Joaquim, and Hasar, Ugr Cem, "Resolving Phase Ambiguity in the Inverse Problem of Transmission/Reflection Measurement Methods", J. Infrared Milli Terahz Waves (2011) 32:857-866.
Foster, Ronald M., "A Reactance Theorem", Bell System Technical Journal, pp. 259-267.
Rajad, Khalid Z., Hao, Yang, Bao, Di, Parini, Clive G., Vazquez, Javier, and Philippakis, Mike, "Stability of active magnetoinductive metamaterials", Journal of Applied Physics 108, 054904 (2010).
Chen, Hongsheng, Ran, Lixin, Huangfu, Jiangtao, Zhang, Xianmin and Chen, Kangsheng, "Left-handed materials composed of only S-shaped resonators", Physical Review E 70, 057605 (2004).
Pendry, J.B., Holden, A.J., Steward, W.J. and Youngs, I., "Extremely Low Frequency Plasmons in Metallic Mesostructures", Physical Review Letters, vol. 76, No. 25, Jun. 17, 1996, pp. 4773-4776.
Smith, D.R., Padilla, Willie J., Vier, D.C., Nemat-Nasser, S.C., and Schultz, S., "Composite Medium with Simultaneously Negative Permeability and Permittivity", Physical Review Letters, vol. 84, No. 18, May 1, 2000, pp. 4184-4187.

* cited by examiner

WIDEBAND NEGATIVE-PERMITTIVITY AND NEGATIVE-PERMEABILITY METAMATERIALS UTILIZING NON-FOSTER ELEMENTS

CROSS-REFERENCE TO RELATED APPLICATION(S)

The present patent application/patent claims the benefit of priority of U.S. Provisional Patent Application No. 61/597,875, filed on Feb. 13, 2012, and entitled "WIDEBAND NEGATIVE-PERMITTIVITY METAMATERIALS AND NEGATIVE-PERMEABILITY METAMATERIALS," the contents of which are incorporated in full by reference herein.

STATEMENT REGARDING FEDERALLY SPONSORED RESEARCH OR DEVELOPMENT

The U.S. Government may have certain rights in the present invention pursuant to National Science Foundation Grant No. ECCS-1101939.

FIELD OF THE INVENTION

The present invention relates generally to the fields of electrical engineering and materials science. More specifically, the present invention relates to wideband negative-permittivity and negative-permeability metamaterials utilizing non-Foster elements.

BACKGROUND OF THE INVENTION

Metamaterials are defined as artificial materials that are engineered to have properties that are not found in nature, and that are not necessarily possessed by their constituent parts alone. In this sense, metamaterials are assemblies of multiple individual elements or unit cells, and they may be on any scale, from nano to bulk.

Metamaterials offer tremendous potential in a wide range of applications, including, but not limited to, negative refraction, wideband antennas near metal, flat lenses, and cloaking Although there has been considerable progress in passive metamaterials, the bandwidth of these devices remains limited by the resonant behavior of the fundamental particles or unit cells comprising the metamaterials. In contrast, non-Foster circuit elements offer the possibility of achieving performance capabilities well beyond the reach of passive components. As is well known to those of ordinary skill in the art, non-Foster circuit elements are those that do not obey Foster's theorem. A complete wideband double-negative metamaterial design has remained elusive, but is provided by the present invention through the use of non-Foster circuit elements. As is also well known to those of ordinary skill in the art, non-Foster circuit elements can be constructed from arrangements of capacitors, inductors, and active devices, such as Linvill circuits, current conveyors, cross-coupled transistors, tunnel diodes, etc.

The closest known art (although not necessarily predating the present invention) is that of Colburn et al. (U.S. Patent Application Publication No. 2012/0256811). Colburn et al. provide:

> A tunable impedance surface, the tunable surface including a plurality of elements disposed in a two dimensional array; and an arrangement of variable negative reactance circuits for controllably varying negative reactance between at least selected ones of adjacent elements in the aforementioned two dimensional array.

The tunable impedance surface of Colburn et al., however, suffers from several significant shortcomings, including, but not limited to: the fact that it is inherently limited to a two-dimensional (2-D) surface, rather than a three-dimensional (3-D) volume; its requirement for a ground plane; and the fact that it only addresses 2-D negative inductance methods, rather than 3-D negative permittivity methods, negative permeability methods, and double-negative metamaterials that exhibit simultaneous negative permittivity and negative permeability. Further, the tunable impedance surface of Colburn et al. considers the stability of non-Foster circuits, but does not consider a metamaterial design wherein a negative capacitive element or negative inductive element is combined with a positive capacitive element or positive inductive element, resulting in a stable element with a net positive inductance or net positive capacitance.

BRIEF SUMMARY OF THE INVENTION

In various exemplary embodiments, the present invention provides a novel wideband double-negative metamaterial having simultaneous negative relative permittivity and negative relative permeability (with both relative permittivity $\epsilon_r$ and relative permeability $\mu_r$ below 0), from 1.0 to 4.5 GHz, for example. Further, in various exemplary embodiments, the present invention provides a novel wideband metamaterial having simultaneous permittivity and permeability below 1 (with both relative permittivity $\epsilon_r$ and relative permeability $\mu_r$ below 1), from 1.0 to 4.5 GHz, for example. Non-Foster loads, such as negative capacitors, negative inductors, and negative resistors, which operate at many frequencies, are coupled to electric and/or magnetic fields using single split-ring resonators (SSRRs), electric disk resonators (EDRs) consisting of two metal disks connected by a metal rod or wire, and other suitable coupling devices. The designs of the loads for the SSRR and EDR that comprise the unit cell are based on an analysis of the coupled fields. The required negative inductance load of the SSRR is derived using Faraday's law of induction, the geometry of the coupling device, and the incident magnetic field. The required negative capacitance load of the EDR is derived using Ampere's circuital law, the geometry of the coupling device, and the incident electric field. The results from Faraday's law and Ampere's law are then used to compute the magnetic and electric dipole moments of the unit cell, and to derive the effective permittivity and effective permeability. This straightforward analysis leads to a relatively simple expression for the resulting negative effective permittivity and negative effective permeability of the unit cell as a function of frequency, with the elimination of typical resonant behavior. As is well known to those of ordinary skill in the art, mixing effects, such as the Maxwell Garnett equation, Bruggeman's Effective Medium Theory, and the Landau-Lifshits-Looyenga mixing rule, are included in a more detailed analysis.

In one exemplary embodiment, the present invention provides a metamaterial exhibiting an effective relative permeability below unity over a wide bandwidth, including: one of a two-dimensional and a three-dimensional arrangement of unit cells, wherein each of the unit cells has a magnetic dipole moment that is dependent upon one or more of an incident magnetic field and an incident electric field; and a coupling mechanism operable for coupling one or more of the incident magnetic field and the incident electric field to a device. Optionally, the coupling mechanism is a split ring. Other exemplary coupling mechanisms that can be used include SSRRs, EDRs, double split-ring resonators (DSRRs), electric-LC resonators, omega particles, capacitively-loaded strips, cut-wire pairs, complementary split-ring resonators (CSRRs), dipoles, asymmetric triangular electromagnetic resonators, S-shaped resonators, etc. The device is a non-Foster element. Optionally, the non-Foster element includes an arrangement of one or more negative capacitors. Alternatively, the non-Foster element includes an arrangement of one or more negative inductors. Alternatively, the non-Foster element includes an arrangement of one or more negative resistors. Alternatively, the non-Foster element includes an arrangement of a negative capacitor in parallel with a negative inductor. Other possibilities, of course, include various combinations and arrangements of negative capacitors, negative inductors, positive capacitors, positive inductors, resistors, negative resistors, transistors, and/or diodes to achieve the desired frequency dependent non-Foster impedances.

In another exemplary embodiment, the present invention provides a metamaterial exhibiting an effective relative permittivity below unity over a wide bandwidth, including: one of a two-dimensional and a three-dimensional arrangement of unit cells, wherein each of the unit cells has an electric dipole moment that is dependent upon one or more of an incident magnetic field and an incident electric field; and a coupling mechanism operable for coupling one or more of the incident magnetic field and the incident electric field to a device. Optionally, the coupling mechanism is a pair of parallel plates coupled by one of a rod and a wire. Other exemplary coupling mechanisms that can be used include EDRs, SSRRs, DSRRs, electric-LC resonators, omega particles, capacitively-loaded strips, cut-wire pairs, CSRRs, dipoles, asymmetric triangular electromagnetic resonators, S-shaped resonators, etc. The device is a non-Foster element. Optionally, the non-Foster element includes an arrangement of one or more negative capacitors. Alternatively, the non-Foster element includes an arrangement of one or more negative inductors. Alternatively, the non-Foster element includes an arrangement of one or more negative resistors. Other possibilities, of course, include various combinations and arrangements of negative capacitors, negative inductors, positive capacitors, positive inductors, resistors, negative resistors, transistors, and/or diodes to achieve the desired frequency dependent non-Foster impedances.

In a further exemplary embodiment, the present invention provides a metamaterial simultaneously exhibiting an effective relative permeability and an effective relative permittivity below unity over a wide bandwidth, including: one of a two-dimensional and a three-dimensional arrangement of unit cells, wherein each of the unit cells has a magnetic dipole moment and an electric dipole moment that are dependent upon one or more of an incident magnetic field and an incident electric field; and a coupling mechanism operable for coupling one or more of the incident magnetic field and the incident electric field to a device. Optionally, the coupling mechanism includes one or more of a split ring and a pair of parallel plates coupled by one of a rod and a wire. Other exemplary coupling mechanisms that can be used include SSRRs, EDRs, DSRRs, electric-LC resonators, omega particles, capacitively-loaded strips, cut-wire pairs, CSRRs, dipoles, asymmetric triangular electromagnetic resonators, S-shaped resonators, etc. The device is a non-Foster element. Optionally, the non-Foster element includes an arrangement of one or more negative capacitors. Alternatively, the non-Foster element includes an arrangement of one or more negative inductors. Alternatively, the non-Foster element includes an arrangement of one or more negative resistors. Alternatively, the non-Foster element includes an arrangement of a negative capacitor in parallel with a negative inductor. Other possibilities, of course, include various combinations and arrangements of negative capacitors, negative inductors, positive capacitors, positive inductors, resistors, negative resistors, transistors, and/or diodes to achieve the desired frequency dependent non-Foster impedances.

BRIEF DESCRIPTION OF THE DRAWINGS

The present invention is illustrated and described herein with reference to the various drawings, in which like reference numbers are used to denote like structural components/method steps, as appropriate, and in which.

DETAILED DESCRIPTION OF THE INVENTION

Figure 1:
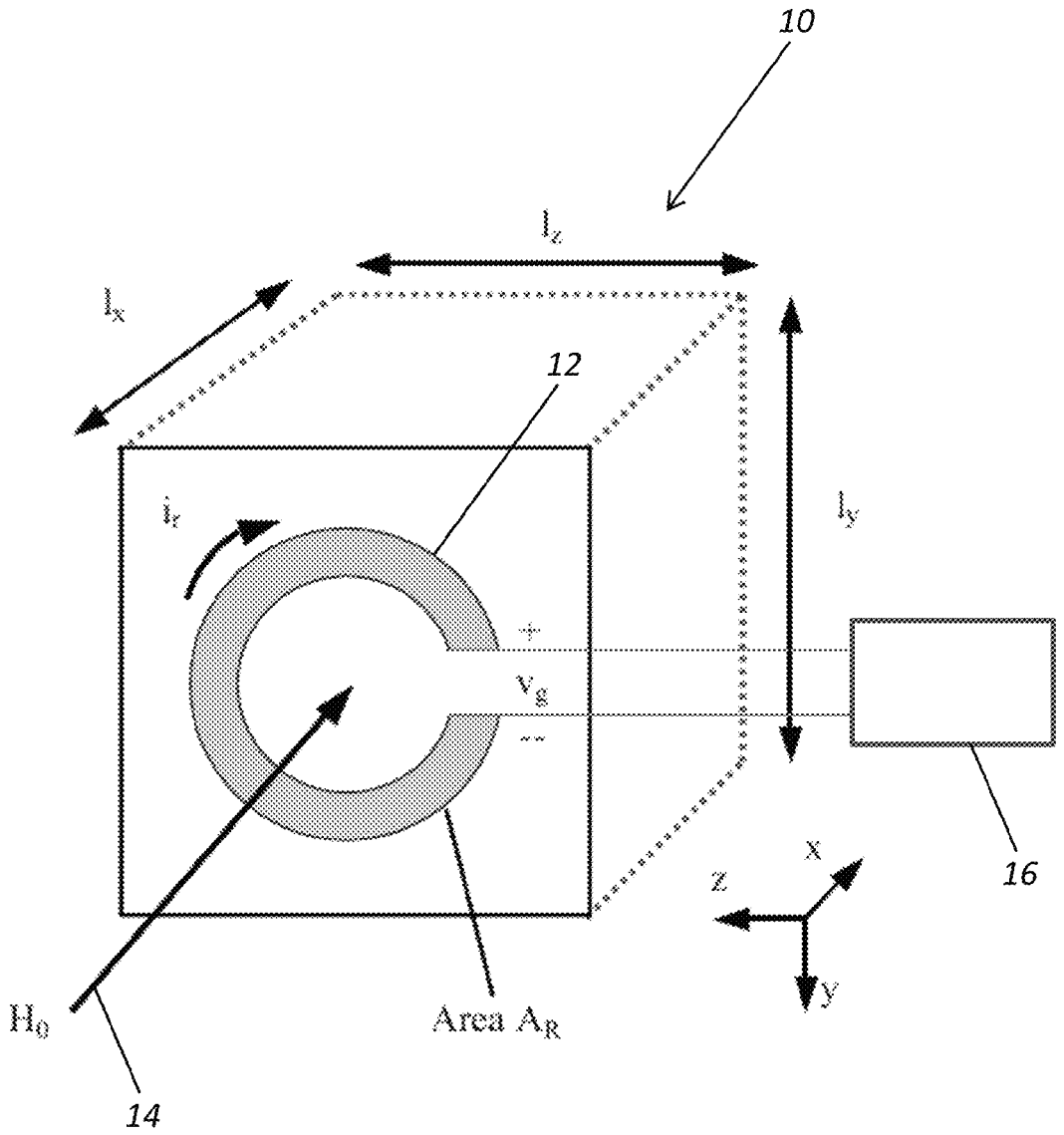
FIG. 1 is a schematic diagram illustrating one exemplary embodiment of a magnetic unit cell of the metamaterial of the present invention, the magnetic unit cell incorporating a single split-ring resonator (SSRR) coupling device and a non-Foster element.

Again, in various exemplary embodiments, the present invention provides a novel wideband double-negative metamaterial having simultaneous negative effective relative permittivity and negative effective relative permeability (with both relative permittivity $\epsilon_r$ and relative permeability $\mu_r$ below 0), from 1.0 to 4.5 GHz, for example. Further, in various exemplary embodiments, the present invention provides a novel wideband metamaterial having simultaneous effective relative permittivity and effective relative permeability below 1 (with both relative permittivity $\epsilon_r$ and relative permeability $\mu_r$ below 1), from 1.0 to 4.5 GHz, for example. Non-Foster loads, such as negative capacitors, negative inductors, and negative resistors, which operate at many frequencies, are coupled to electric and/or magnetic fields using SSRRs, EDRs consisting of two metal disks connected by a metal rod or wire, and other suitable coupling devices. The designs of the loads for the SSRR and EDR that comprise the unit cell are based on an analysis of the coupled fields. The required negative inductance load of the SSRR is derived using Faraday's law of induction, the geometry of the coupling device, and the incident magnetic field. The required negative capacitance load of the EDR is derived using Ampere's circuital law, the geometry of the coupling device, and the incident electric field. The results from Faraday's law and Ampere's law are then used to compute the magnetic and electric dipole moments of the unit cell, and to derive the effective permittivity and permeability. This straightforward analysis leads to a relatively simple expression for the resulting negative effective permittivity and negative effective permeability of the unit cell as a function of frequency, with the elimination of typical resonant behavior. As is well known to those of ordinary skill in the art, mixing effects, such as the Maxwell Garnett equation, Bruggeman's Effective Medium Theory, and the Landau-Lifshits-Looyenga mixing rule, are included in a more detailed analysis.

The analyses and results of the present invention address the problem of narrow bandwidth in double-negative metamaterials, negative permittivity metamaterials, negative permeability metamaterials, metamaterials incorporating electromagnetic coupling devices, and metamaterials with effective relative permittivity and/or effective relative permeability below unity. In this, properly chosen non-Foster loads are shown to provide wideband negative effective permittivity, wideband negative effective permeability, wideband double-negative metamaterials, wideband electromagnetic coupling, and wideband metamaterials with relative permittivity and/or relative permeability below unity. In particular, the permeability of an SSRR becomes independent of frequency with a negative inductance load, and the permittivity of an EDR becomes independent of frequency with a negative capacitor load. Similar results for loop and dipole antennas have been noted. As is well known to those of ordinary skill in the art, various combinations and arrangements of negative capacitors, negative inductors, positive capacitors, positive inductors, resistors, negative resistors, transistors, and/or diodes to achieve the desired frequency dependent non-Foster impedances.

The design of a non-Foster-loaded SSRR with wideband negative effective permeability is first considered. The design of a non-Foster-loaded EDR with wideband negative effective permittivity is then considered. Finally, simulation results of wideband double-negative metamaterials are given, with effective permittivity and permeability extracted from the S-parameters of the metamaterial.

The well-known theory of an elementary lossless SSRR is first considered, since it is useful in describing the overall analysis approach for the proposed negative-permittivity metamaterials. Although other magnetic field coupling devices may have advantages and may be used, they would unnecessarily complicate the basic development outlined here.

Consider the magnetic unit cell 10 and SSRR 12 illustrated in FIG. 1 that, in the prior art, is expected to exhibit typical narrowband resonant behavior. The dimensions of the unit cell 10 comprising this magnetic metamaterial particle are $l_x$, $l_y$, and $l_z$, and the metal split ring 12 has an area $A_R$. As usual, the dimensions of the unit cell 10 are considered to be significantly smaller than a wavelength. The incident magnetic field $H_o\hat{x}$ is parallel to the axis of the split ring 12.

As illustrated in FIG. 1, the current in the split ring 12 is defined as $i_r$, and the voltage across the gap is $v_g$ (this sign convention for $i_r$ and $v_g$ is later convenient for describing the current through the capacitance of the gap in the split ring 12). Using Faraday's law of induction, the gap voltage is:

$$v_g = -\frac{d\Phi_T}{dt} = -\frac{d(\Phi_0 + \Phi_R)}{dt}, \tag{1}$$

where $\Phi_T$ is the total magnetic flux in the SSRR 12, $\Phi_0=\mu_0 H_0 A_R$ is the incident magnetic flux over the SSRR 12, $A_R$ is the area of the SSRR 12, $\mu_0$ is the permeability of a vacuum, and $\Phi_R$ is the magnetic flux due to $i_r$. Then, the current in the ring 12 is:

$$i_r = C_g \frac{dv_g}{dt} = -C_g \frac{d^2(\Phi_0 + \Phi_R)}{dt^2}, \tag{2}$$

where $C_g$ is the total capacitance across the gap of the SSRR 12.

Taking the Laplace transform:

$$i_r = -s^2 C_g(\Phi_0+\Phi_R) = -s^2 C_g(\Phi_0+L_R i_r), \tag{3}$$

where the self-inductance of the SSRR 12 is $L_R=\Phi_R/i_r$.

Solving for $i_r$ yields the frequency-dependent current:

$$i_r = -\Phi_0 \frac{s^2 C_g}{1 + s^2 L_R C_g}, \tag{4}$$

Next, consider replacing the gap capacitance $C_g$ with a positive inductance $L_g$ with reactance $X_g=j\omega L_g$. The voltage $v_g$ now appears across this gap inductance $L_g$. Then, the current in the split ring 12 becomes:

$$i_r = \frac{1}{L_g}\int v_g dt = -\frac{1}{L_g}\int \frac{d(\Phi_0 + \Phi_R)}{dt} dt, \tag{5}$$

after substituting for $v_g$ from Eq. (1). Taking the integral, and again with $L_R=\Phi_R/i_r$, leads to:

$$i_r = -\frac{1}{L_g}(\Phi_0 + \Phi_R) = -\frac{1}{L_g}(\Phi_0 + L_R i_r), \tag{6}$$

Then, solving for $i_r$ results in:

$$i_r = -\Phi_0 \frac{1}{L_g + L_R}, \tag{7}$$

Comparing Eq. (7) with Eq. (4), the ring current $i_r$ in Eq. (7) no longer depends on frequency when the gap capacitance $C_g$ is replaced by inductance $L_g$, allowing wideband behavior.

The current in the loop gives rise to a magnetic dipole moment in the SSRR 12 of $m=i_r A_r \hat{x}$. The minus sign in Eq. (7) then results in m having a direction opposite to the applied field $H_0\hat{x}$. The macroscopic magnetization M is then the magnetic dipole moment per unit volume:

$$M = -\Phi_0 \frac{A_R}{l_x l_y l_z} \frac{1}{L_g + L_R}\hat{x} = -\mu_0 H_0 \frac{A_R^2}{l_x l_y l_z} \frac{1}{L_g + L_R}\hat{x}, \tag{8}$$

where the permeability of free space is $\mu_0=1.26\times10^{-6}$ H/m, and for the simplicity of exposition, well-known mixing effects, such as Bruggeman's Effective Medium Theory, are not included here. With $M=\chi_m H$ and $\mu_r=1+\chi_m$, it follows that:

$$\mu_r = 1 - \mu_0 \frac{A_R^2}{l_x l_y l_z} \frac{1}{L_g + L_R}, \tag{9}$$

where $\chi_m$ is the magnetic susceptibility, and $\mu_r$ is the effective relative permeability of the metamaterial.

The proposed effective relative permeability $\mu_r$ for the SSRR 12 given in Eq. (9) does not vary with frequency, and becomes a large negative value if $L_g$ is chosen to be negative, such that the denominator has $(L_g+L_R)>0$ and $(L_g+L_R)\approx0$. Thus, a negative inductor load in the gap of a SSRR 12 can provide wideband negative effective permeability. The desired condition $(L_g+L_R)>0$ has the same form as a series combination of a negative inductor with a positive inductor whose resulting inductance remains positive. Non-Foster circuits, such as a negative inductor, can be designed using negative impedance converters, where recent progress has been made in potential stability issues. Further, the condition $(L_g+L_R)>0$ results in a net positive inductance, which leads to stability. The non-Foster element 16 is shown conceptually in FIG. 1.

Just as the theory of the SSRR 12 is developed above for wideband negative-permeability metamaterials, a similar approach is used to develop the theory for the proposed wideband negative-permittivity metamaterials. The analysis follows along similar lines as the analysis of the magnetic unit cell 10 of FIG. 1.

Figure 2A:
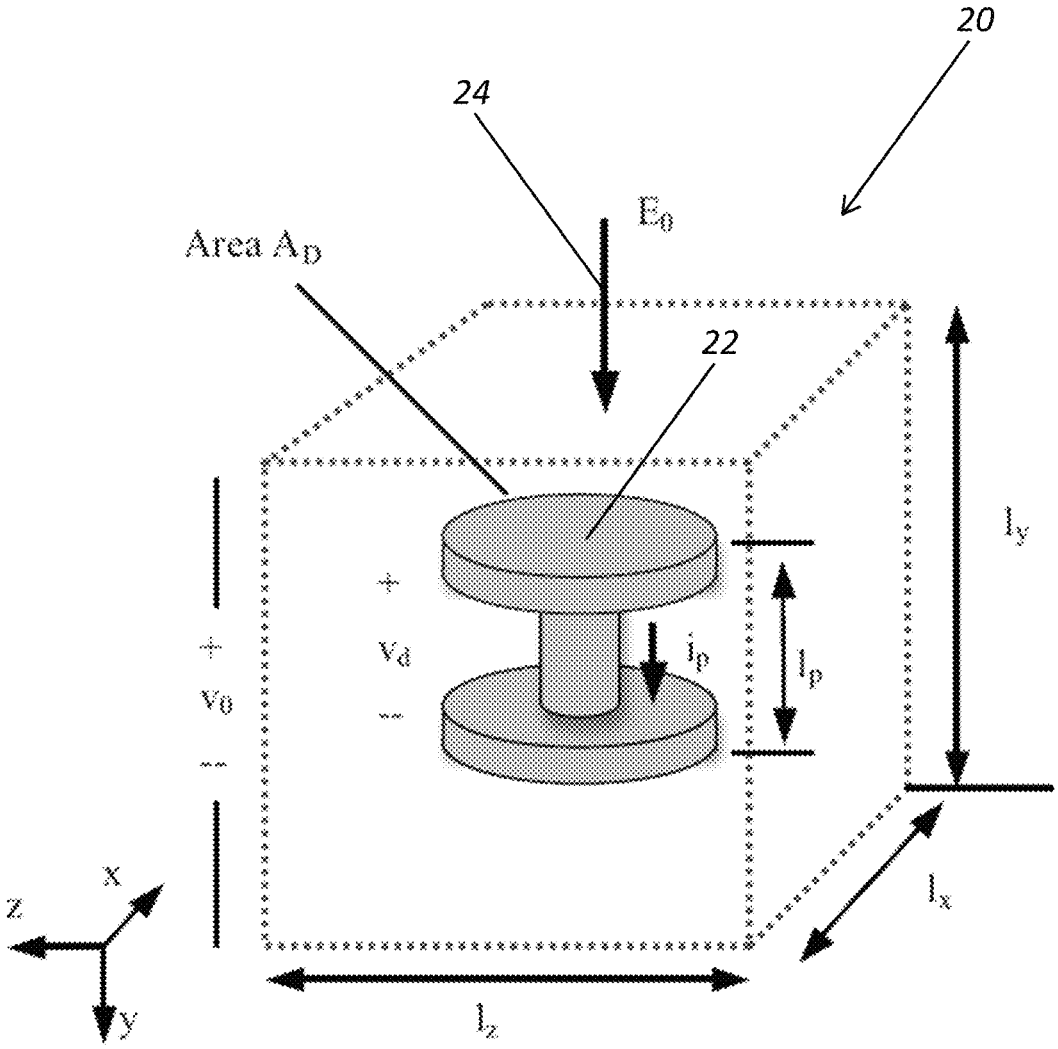
FIGS. 2*a*-2*c* are schematic diagrams illustrating exemplary embodiments of an electric unit cell of the metamaterial of the present invention, the electric unit cell incorporating an electric disk resonator (EDR) coupling device and a non-Foster element.
Figure 2B:
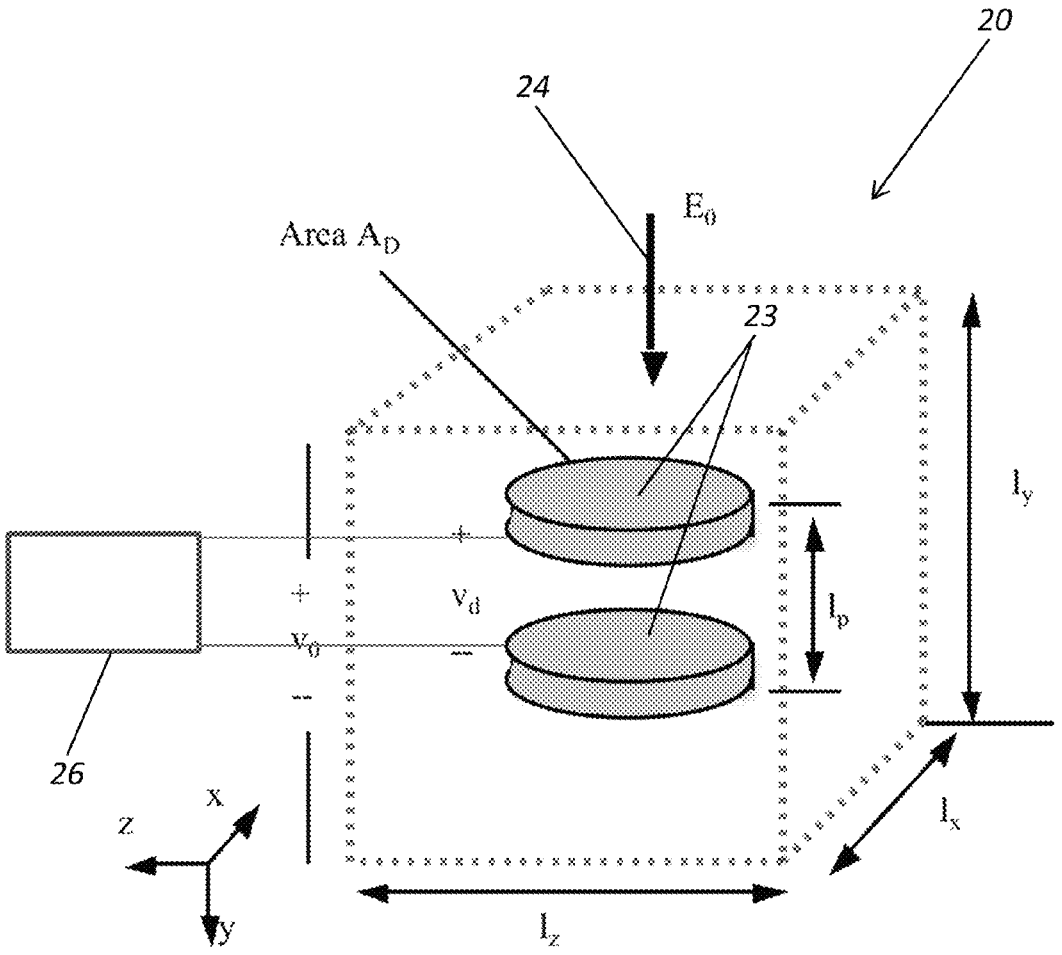
Figure 2C:
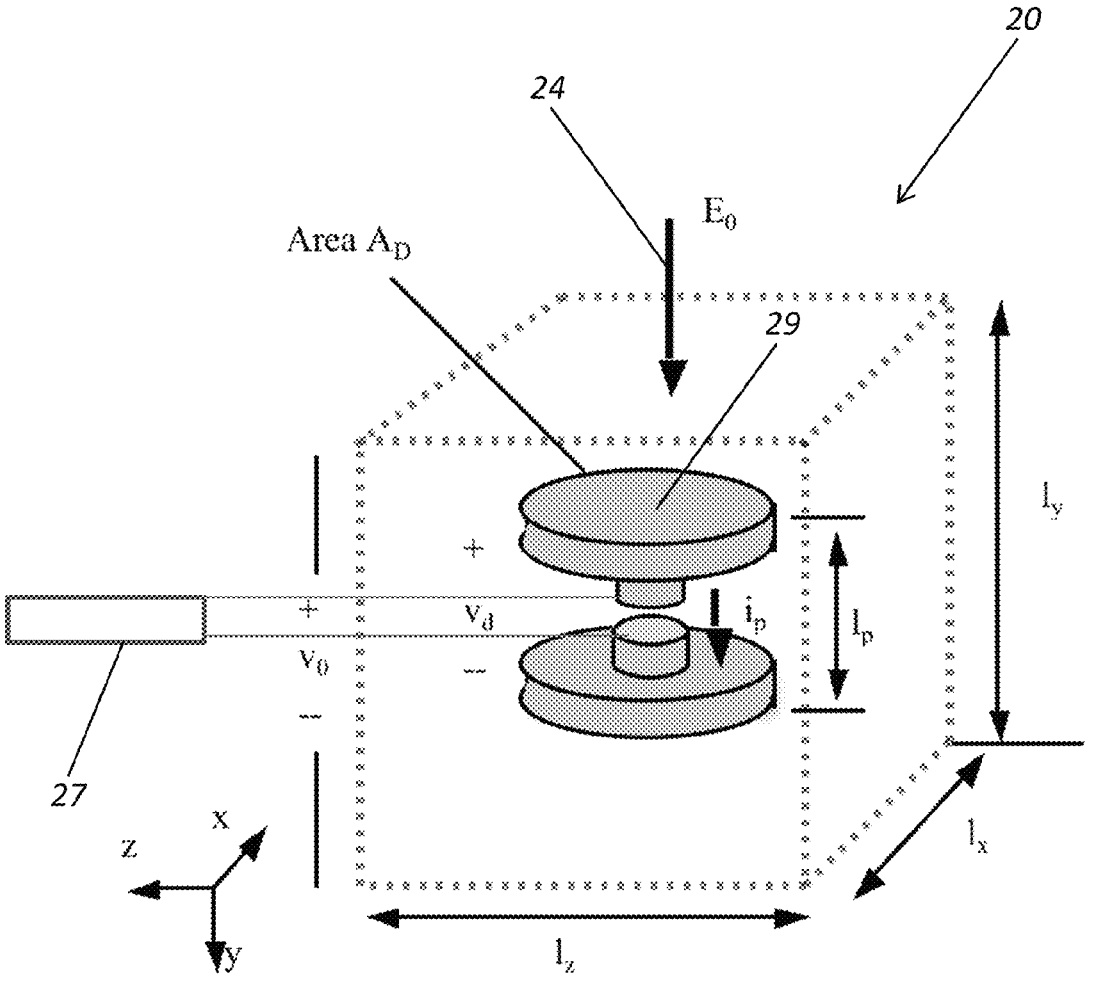

Consider the electric unit cell 20 and EDR 22 illustrated in FIG. 2, resembling a three-dimensional version of an I-shaped structure. The dimensions of the unit cell 20 comprising this electric metamaterial particle are the same as the magnetic component of FIG. 1, $l_x$, $l_y$, and $l_z$. The metal disks near the top and bottom faces of the structure have areas $A_D$, and are connected together by a metal post with inductance $L_p$. As usual, the dimensions of the unit cell 20 are taken to be less than a wavelength, so that the incident electric field $E_0\hat{y}24$ is uniform over the unit cell 20. As illustrated in FIG. 2, the current in the post that connects the two disks is $i_p$, and the voltage between the upper and lower disks is $v_d$.

Using Ampere's circuital law and the Maxwell-Ampere equation, the time derivative of the total electric flux impinging upon the top face of the upper disk equals the current in the post plus the time derivative of total electric flux departing the bottom face of the top disk:

$$i_p + \frac{d}{dt}\Psi_F = \frac{d}{dt}\Psi_T, \tag{10}$$

where $i_p$ is the current in the post, $\Psi_T$ is the total electric flux in coulombs impinging upon the top face of the upper disk of the EDR 22 from sources external to the unit cell 20, and $\Psi_F$ is the total electric flux that couples between the upper and lower EDR disks (i.e. internal to the unit cell 20). The left side of Eq. (10) then represents the total current (both circuit current and displacement current) flowing from the top disk to the bottom disk, and the right side represents the total displacement current coming from sources external to the unit cell 20 and impinging on the top disk of the EDR 22.

The internal electric flux $\Psi_F$ can be represented by a capacitance $C_F$ driven by the voltage $v_d$ across the two disks, and the external electric flux $\Psi_T$ can be represented by a capacitance $C_0$ coupling to the external voltage potential across the unit cell 20 $v_0=E_0 l_y$, where $E_0\hat{y}$ is the incident electric field. Then, Eq. (10) becomes:

$$i_p = \frac{d}{dt}(v_0 C_0 - \Psi_F) = \frac{d}{dt}(v_0 C_0 - v_d C_F), \tag{11}$$

where capacitance $C_F$ can also be thought of as a leakage capacitance or fringe capacitance around the post inductance. The voltage between the two disks also equals the voltage across the inductive post, so:

$$v_p = L_p \frac{di_p}{dt} = L_p \frac{d^2}{dt^2}(v_0 C_0 - v_d C_F), \tag{12}$$

where $v_d$ is the voltage from the top disk to the bottom disk, as before, and $L_p$ is the inductance of the metal post connecting the two disks. Taking the Laplace transform results in:

$$v_d = s^2 L_p (v_0 C_0 - v_d C_F). \tag{13}$$

Solving for the voltage $v_d$ then gives:

$$v_d = v_0 \frac{s^2 L_p C_0}{1 + s^2 L_p C_F}. \tag{14}$$

Next, consider replacing the inductive post $L_p$ with a positive capacitance $C_p$ with reactance $X_p=-j/(\omega C_p)$. The current $i_p$ then flows through this capacitance and the voltage $v_d$ now appears across this capacitance, so:

$$v_d = \frac{1}{c_p}\int i_p dt = \frac{1}{c_p}\int \frac{d}{dt}(v_0 C_0 - v_d C_F)dt, \tag{15}$$

after substituting for $i_p$ from Eq. (11). Simplifying and solving for $v_d$ results in:

$$v_d = \frac{1}{c_p}(v_0 C_0 - v_d C_F) = v_0 \frac{c_0}{c_p + c_F}. \tag{16}$$

Comparing Eq. (16) with Eq. (14), note that the voltage $v_d$ in Eq. (16) no longer depends on frequency when the post inductance $L_p$ is replaced by $C_p$, thus allowing wideband behavior.

The charge on the disks then gives rise to an electric dipole moment:

$$p = q l_p \hat{y} = v_d C_p l_p \hat{y} = v_0 C_0 l_p \frac{c_p}{c_p + c_F}\hat{y}, \tag{17}$$

where $\pm q$ is the charge in coulombs on the disks, p is the electric dipole moment in the same direction as the applied field $E_0\hat{y}$, and $l_p$ is the distance between the two disks. In Eq.

(17), the charge on the bottom disk is $q=\int i_p dt$ and $v_d=(1/C_p)\int i_p dt$, so $q=v_d C_p$. Then, polarization P equals electric dipole moment per unit volume:

$$P = \frac{p}{l_x l_y l_z} = E_0 \frac{c_0 l_p}{l_x l_z}\left(\frac{c_p}{c_p + c_F}\right)\hat{y}, \tag{18}$$

after substituting $E_0 l_y = v_0$, and for the simplicity of exposition, well-known mixing effects, such as Bruggeman's Effective Medium Theory, are again not included here. With $P=\chi_e \epsilon_0 E$ and $E_r=1+\chi_e$, the relative permittivity $\epsilon_r$ is:

$$\epsilon_r = 1 + \frac{c_0 l_p}{\epsilon_0 l_x l_z}\left(\frac{c_p}{c_p + c_F}\right), \tag{19}$$

where $\chi_e$ is the electric susceptibility, $\epsilon_r$ is the effective relative permittivity of the metamaterial, and $\epsilon_0=8.85\times10^{-12}$ F/m is the permittivity of free space.

Therefore, the effective relative permittivity $\epsilon_r$ of the EDR 22 in Eq. (19) does not vary with frequency, just as there was no frequency dependence in $\mu_r$ for the SSRR 12 result of Eq. (9). The effective permittivity $\epsilon_r$ becomes a large negative value if $C_p$ is chosen to be negative, such that the denominator has $C_p+C_F\approx0$ and $C_p+C_F>0$. Thus, a negative capacitor load replacing the post of an EDR 22 can provide wideband negative effective permittivity. The desired condition $C_p+C_F>0$ has the same form as a parallel combination of a negative capacitor with a positive capacitor whose resulting capacitance remains positive. Further, the condition $C_p+C_F>0$ results in a net positive capacitance, which leads to stability. Non-Foster circuits, such as a negative capacitor, can be designed using negative impedance converters, where recent progress has been made in potential stability issues. The non-Foster element 26 is shown conceptually in FIG. 2*b*, where the non-Foster element 26 coupled the two disks 23, with the non-Foster element 26 replacing the inductive post of the EDR 22. In an alternative arrangement shown in FIG. 2*c*, the inductive post of the EDR 22 is cut in two, with the non-Foster element 27 coupling the remaining portions of the split EDR 29. Furthermore, in some applications, metamaterials do not necessarily need to exhibit negative permittivity and/or negative permeability, since devices with non-negative refractive indices less than unity or near zero can also be useful.

Figure 3:
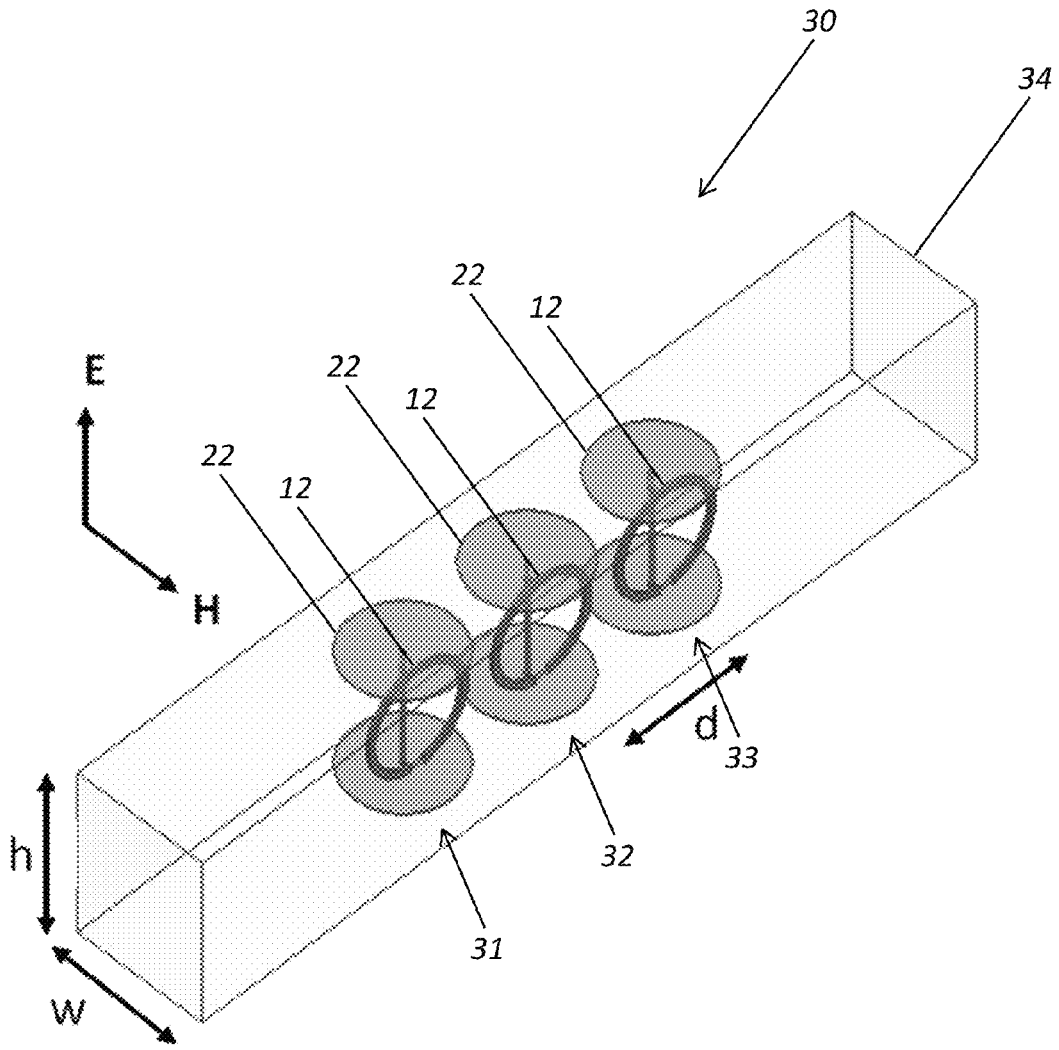
FIG. 3 is a schematic diagram illustrating one exemplary embodiment of the double-negative metamaterial structure of the present invention, the structure incorporating three SSRR and three EDR coupling devices and six non-Foster elements.

The wideband double-negative metamaterial test structure 30 illustrated in FIG. 3 was chosen to illustrate the performance of the proposed design. The structure consisted of three unit cells 31, 32, and 33 within a parallel-plate waveguide 34 with perfect electric conductor top and bottom walls separated by h=10 mm, and perfect magnetic conductor side walls separated by w=8 mm. The separation between unit cells was d=8 mm. The SSRR 12 had a radius of 3.2 mm with a 1-mm gap, and the EDR 22 was comprised of two disks 7 mm apart with 3.2-mm radius and a connecting post of 0.15-mm radius. The EDR 22 and SSRR 12 were centered within the waveguide 34, with 1-mm space between the EDR post and SSRR ring. Each EDR 22 had a 1-mm gap in its post with a negative capacitance of Cp=−240 fF placed in the gap. Each SSRR 12 had a 1-mm gap in its ring with a negative inductance of Lp=−10 nH placed in the gap. In addition, a negative capacitance of −45 fF was placed in parallel to Lp to compensate for stray capacitance in the ring 12 to help improve bandwidth.

Figure 4:
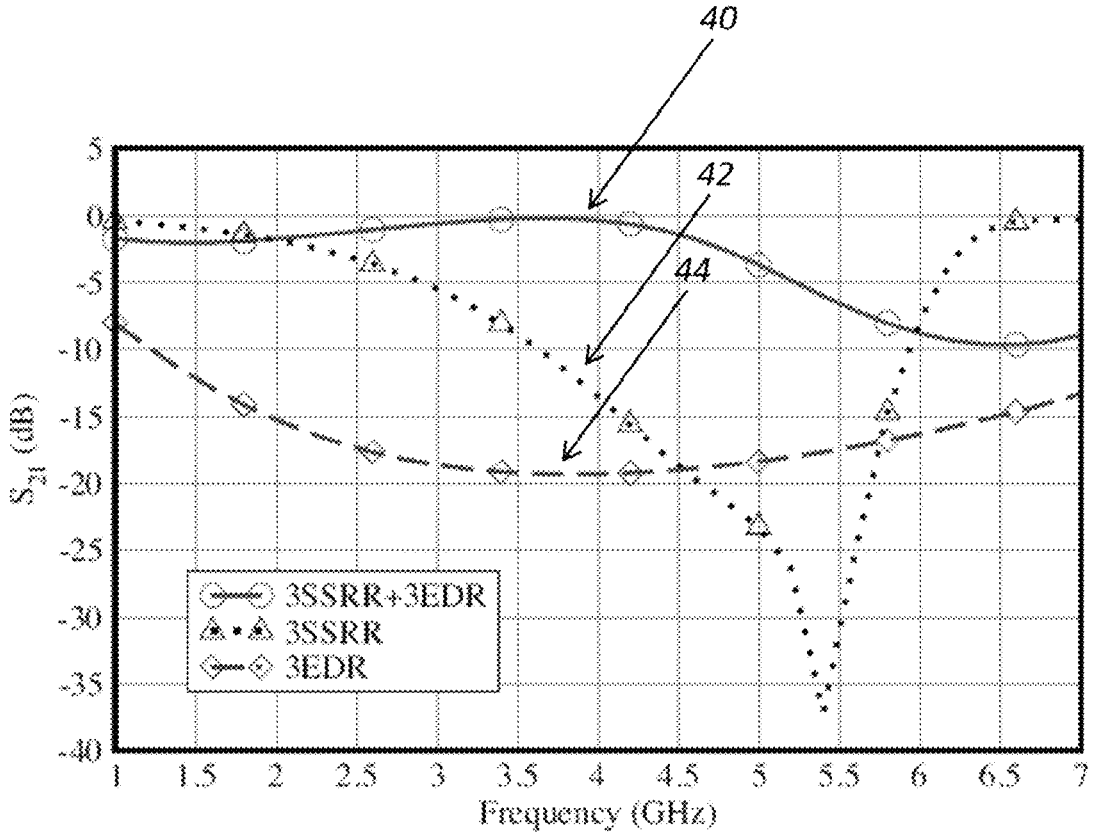
FIG. 4 is a plot illustrating exemplary simulation results for the structure of FIG. 3.

The structure 30 of FIG. 3 was tested in the HFSS 3D electromagnetic simulator. FIG. 4 illustrates the S-parameter simulation results for $S_{21}$ for three cases. The solid curve with circles 40 in FIG. 4 illustrates $|S_{21}|$ in dB for the entire structure 30 of FIG. 3, and illustrates wideband double-negative behavior with less than 2 dB loss from 1.0 to 4.5 GHz. The dotted curve with triangles 42 illustrates $|S_{21}|$ for the three SSRR devices 12, with the three EDR devices 22 removed. In the dotted curve 42, the insertion loss is due to the negative effective permeability of the three SSRR devices 12 alone. The dashed curve with diamonds 44 shows $|S_{21}|$ for the three EDR devices 22, with the three SSRR devices 12 removed. In the dashed curve 44, the insertion loss is due to the negative effective permittivity of the three EDR devices 22 alone.

Figure 5:
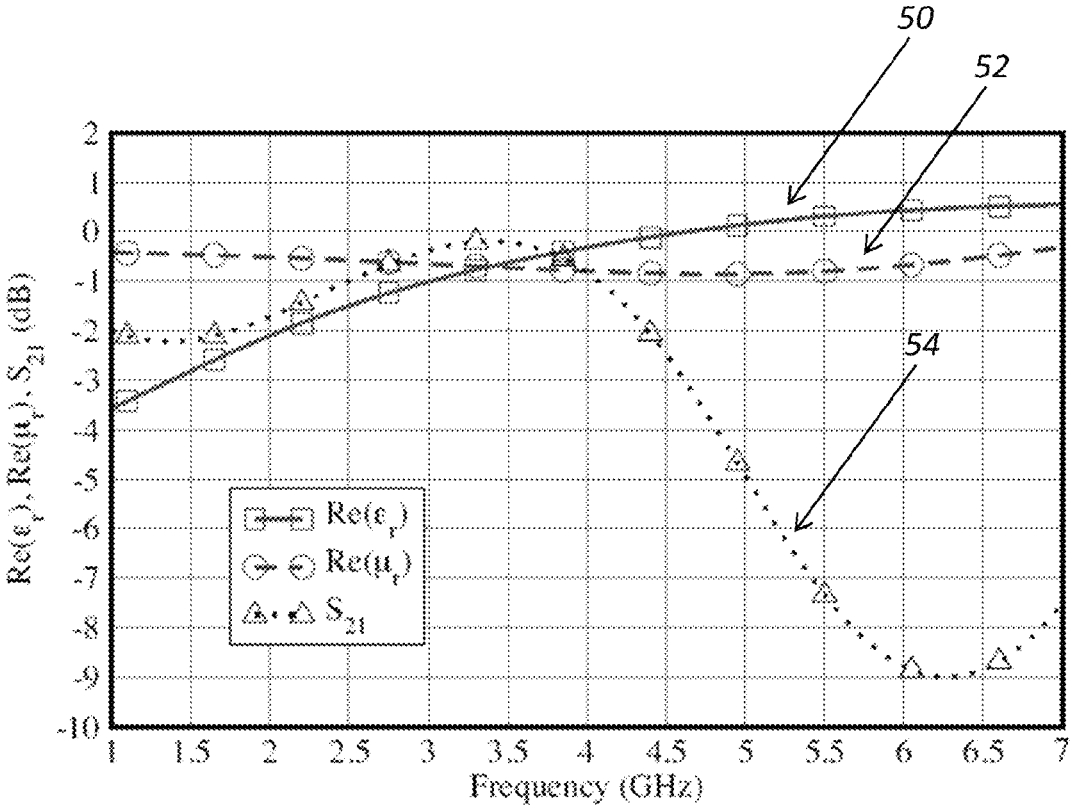
FIG. 5 is a plot illustrating exemplary extracted values of the real parts of the effective relative permeability $\mu_r$ and effective relative permittivity $\epsilon_r$ for the structure of FIG. 3.

The effective permeability and effective permittivity of the three unit cell structure 30 of FIG. 3 were extracted from the S-parameters of FIG. 4, drawing upon common methods. FIG. 5 illustrates the real part of the effective relative permittivity (solid curve with squares 50) and the real part of the effective relative permeability (dashed curve with circles 52), both on a linear scale. The dotted curve with triangles 54 shows $|S_{21}|$ in dB for reference. Note that both the real parts of the relative permittivity $\epsilon_r$ and relative permeability $\mu_r$ remain negative from 1.0 to 4.5 GHz. Near 1 GHz, the real part of $\epsilon_r$ approaches −3.5, while the real part of $\mu_r$ approaches −0.3. Near 5 GHz, $\epsilon_r$ becomes positive while $\mu_r$ remains negative, suggesting an evanescent non-propagating condition above 4.5 GHz. Also, the attenuation greatly increases above 5 GHz, as would be expected when $\epsilon_r$ becomes positive while $\mu_r$ remains negative. Further, the effective relative permittivity is between 0 and 1 from 5 GHz to 7 GHz.

Analysis and simulation results for the proposed non-Foster metamaterial 30 confirm wideband double-negative behavior. Effective permittivity and permeability were extracted from S-parameters and confirm simultaneous negative permittivity and negative permeability from 1.0 to 4.5 GHz.

Again, magnetic metamaterial unit cells 10 are commonly narrowband and dispersive. However, the appropriate use of non-Foster elements 16 can increase the bandwidth of the metamaterials. Therefore, the present invention further addresses the deleterious effects of parasitic fringe capacitance on the bandwidth of a SSRR 12 when loaded with an ideal non-Foster circuit element 16. Analysis of the parasitics leads to modified equations for effective permeability, and simulation results confirm the potential for significantly improved bandwidth.

For simplicity, a lossless SSRR 12 is used to illustrate the influence of parasitic fringe capacitance on the effective permeability of the metamaterial when using non-Foster elements 16. Consider again the SSRR 12 illustrated in FIG. 1, centered in a unit cell 10 with dimensions $l_x$, $l_y$, and $l_z$. The area of the SSRR 12 is $A_R$ and the incident magnetic field $H_0$ 14 is parallel to the axis of the SSRR 12. Due to the change in the magnetic field, a voltage $v_g$ appears across the gap of the ring 12. The gap in the ring 12 can be modeled as a capacitance $C_g$. The current $i_r$ in the ring 12 and through capacitance $C_g$ is then:

$$i_r = C_g \frac{dv_g}{dt} = -C_g \frac{d^2(\Phi_0 + \Phi_R)}{dt} = -\Phi_0 \frac{s^2 C_g}{1 + s^2 L_R C_g}, \tag{20}$$

where s is the Laplace complex angular frequency, $L_R=\Phi_R/i_r$ is self-inductance, $v_g=-d(\Phi_0+\Phi_R)/dt$, $\Phi_0$ is the incident magnetic flux, and $\Phi_R$ is the magnetic flux due to $i_r$. The well-known result in Eq. (20) describes the conventional narrowband behavior of a SSRR 12, where the magnetic resonance frequency can be defined as $\omega_{0m}-1/\sqrt{L_R C_G}$.

Next, consider replacing gap capacitance $C_g$ with a positive inductance $L_g$ with reactance $X_L=j\omega L_g$. The ring current $i_r$ then becomes:

$$i_r = \frac{1}{L_g}\int v_g dt = -\frac{1}{L_g}(\Phi_0+\Phi_R) = -\Phi_0\frac{1}{L_g+L_R}. \tag{21}$$

Comparing Eq. (20) with Eq. (21), the current in the split ring 12 is now frequency independent and broadband behavior is possible with proper choice of inductance $L_g$.

In some cases, however, capacitance $C_g$ cannot be removed completely, and some parasitic fringe capacitance $C_{Fg}$ will remain. As a result, the equivalent circuit in the gap of the split-ring 12 is now a parallel combination of inductance $L_g$ and fringe capacitance $C_{Fg}$. Modifying Eq. (21) with $C_{Fg}$ yields:

$$i_r = i_{C_{Fg}} + i_{L_g} = C_{Fg}\frac{dv_g}{dt} + \frac{1}{L_g}\int v_g dt, \tag{22}$$

where $i_{CFg}$ is the current through fringe capacitance $C_{Fg}$, and $i_{Lg}$ is the current through inductance $L_g$. Substituting $v_g=-d(\Phi_0+\Phi_R)/dt$ in Eq. (22), taking the Laplace transform, and including self-inductance $L_R$ yields:

$$i_r = -\Phi_0\frac{1+s^2C_{Fg}L_g}{L_R+L_g(1+s^2C_{Fg}L_R)}, \tag{23}$$

The result in Eq. (23) indicates that two resonance frequencies exist.

To find the effective permeability, the magnetic dipole moment is used. The current in the SSRR 12 creates a magnetic dipole moment $m=(i_rA_R)$, and the macroscopic magnetization is then $M=(i_rA_R)/(l_xl_yl_z)$. Since $M=\chi_m H$, $\mu_r=1+\chi_m$, and $\Phi_0=\mu_0H_oA_R$, the relative permeability, $\mu_r$, equals:

$$\mu_r = 1-\mu_0\frac{A_R^2}{l_xl_yl_z}\frac{1-\omega^2C_{Fg}L_g}{L_R+L_g(1-\omega^2C_{Fg}L_R)}, \tag{24}$$

where $\chi_m$ is the magnetic susceptibility, $\omega$ is the angular frequency, $\mu_0=1.26\times10^{-6}$ H/m is the permeability of free space, and $s=j\omega$ was used, and for the simplicity of exposition, well-known mixing effects, such as Bruggeman's Effective Medium Theory, are again not included here.

Finally, the parasitic fringe capacitance $C_{Fg}$ can theoretically be canceled by adding a parallel negative capacitance of equal value such that Eq. (24) becomes:

$$\mu_r = 1-\mu_0\frac{A_R^2}{l_xl_yl_z}\frac{1}{L_R+L_g}, \tag{25}$$

and $\mu_r$ once again becomes frequency independent, making wideband negative effective permeability possible when $L_g$ is negative, $L_R+L_g>0$, and $L_R+L_g\approx0$, according to Eq. (25).

Figure 6:
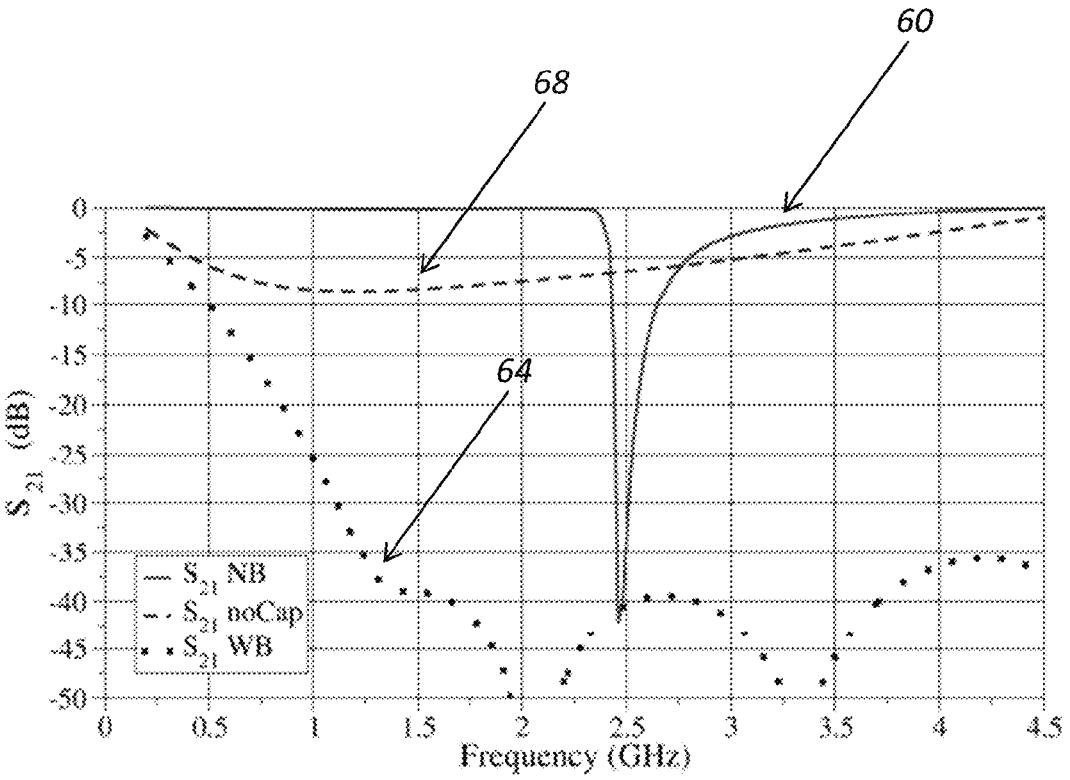
FIG. 6 is a plot illustrating further exemplary simulation results for the structure of FIG. 3 when all three EDR coupling devices are removed.
Figure 7:
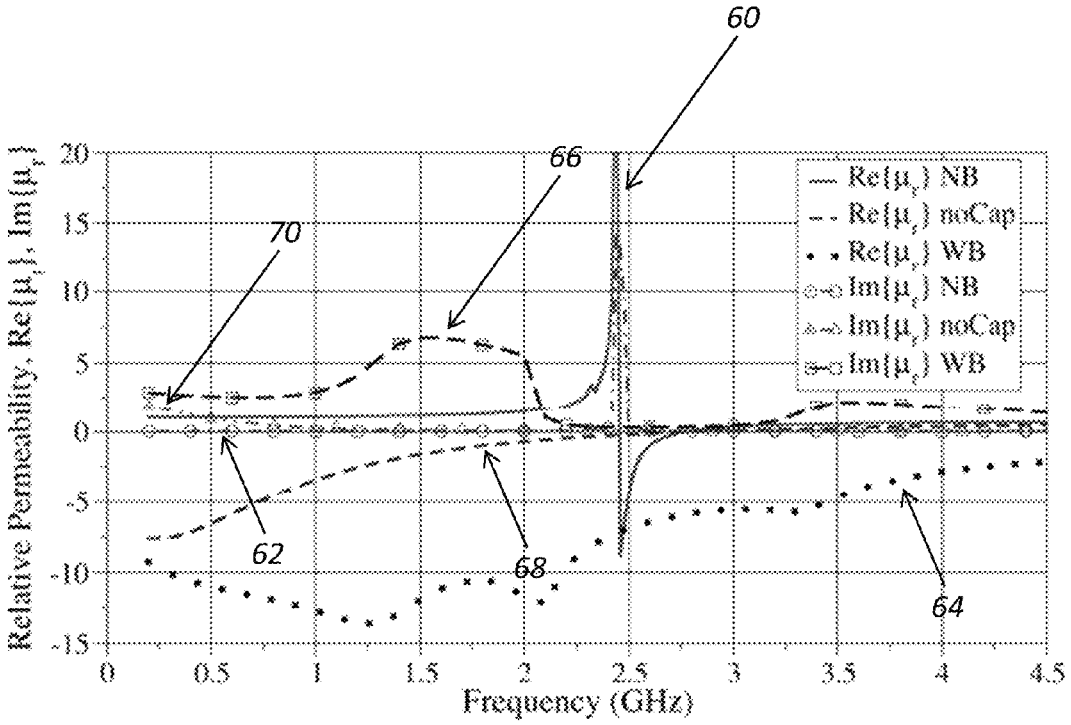
FIG. 7 is a plot illustrating exemplary extracted values of the real and imaginary parts of the permeability $\mu_r$ for the structure of FIG. 3 when all three EDR coupling devices are removed.

Again, the metamaterial structure 30 illustrated in FIG. 3 was simulated with three SSRR devices 12 in a parallel-plate waveguide 34 with perfect electric conductor top and bottom walls and with perfect magnetic conductor side walls, however, with the three EDRs 22 removed in the following three cases. Three cases were simulated. The first case used conventional SSRR devices 12 without non-Foster circuit elements 16. In the second case, all three SSRR devices 12 were loaded with negative capacitance of −47 fF and negative inductance of −16.7 nH to confirm wideband behavior as predicted in Eq. (25). In the final case, the negative capacitance was removed and all three SSRR devices 12 were only loaded with a negative inductance. For the three cases simulated, $S_{21}$ is plotted in FIG. 6 and extracted real and imaginary parts of the effective relative permeability are illustrated in FIG. 7. For both FIGS. 6 and 7, the solid 60 and circle 62 curves describe the conventional narrowband behavior. The magnetic resonance occurs near 2.5 GHz. The dotted 64 and dashed (square) 66 curves illustrate wideband behavior from 0.5 to 4.5 GHz, when both the negative inductance and negative capacitance are present. The dashed 68 and triangle 70 curves depict the result when the negative capacitance is removed.

The deleterious effects of fringe capacitance were analyzed and found, in some cases, to limit the bandwidth of negative effective permeability in non-Foster-loaded SSRRs. The analysis and simulation results demonstrate that a non-Foster load with both negative inductance and negative capacitance is required for wideband behavior, in some cases. As is well known to those of ordinary skill in the art, arrangements of the SSRRs and EDRs of FIG. 3 can be configured to respond to fields along different axes, along two axes, or along all three axes to provide an isotropic medium. An exemplary isotropic medium would orient the unit cells of FIG. 3 along the x, y, and z axes.

As illustrated in the exemplary embodiments provided herein above, the present invention provides wideband metamaterials using non-Foster elements, with inherent stability advantages, and that can be used in a three-dimensional volume, can provide wideband relative permittivity less than unity, can provide wideband relative permeability less than unity, can provide wideband simultaneous relative permittivity and relative permeability less than unity, can provide wideband negative relative permittivity, can provide wideband negative relative permeability, can provide wideband simultaneous negative relative permittivity and negative relative permeability, that does not require a ground plane, and that can compensate for the deleterious effects of stray capacitance. In applications where instability is desirable, such as in oscillators, it is straightforward to violate the stability conditions noted throughout.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A metamaterial exhibiting an effective relative permeability below unity over a wide bandwidth without tuning, comprising:

one of a two-dimensional and a three-dimensional arrangement of unit cells forming a metamaterial, wherein each of the unit cells has a magnetic dipole moment that is produced by one or more of an incident magnetic field and an incident electric field; and a coupling mechanism coupling one or more of the incident magnetic field and the incident electric field to a device;

wherein the device comprises a non-Foster element that provides the metamaterial with an effective relative permeability below unity over a bandwidth comprising a plurality of frequencies such that the plurality of frequencies within the bandwidth are simultaneously tuned.

2. The metamaterial of claim 1, wherein the coupling mechanism comprises a split ring.

3. The metamaterial of claim 1, wherein the non-Foster element comprises an arrangement of one or more negative capacitors.

4. The metamaterial of claim 1, wherein the non-Foster element comprises an arrangement of one or more negative inductors.

5. The metamaterial of claim 1, wherein the non-Foster element comprises an arrangement of one or more negative resistors.

6. The metamaterial of claim 1, wherein the non-Foster element comprises an arrangement of a negative capacitor in parallel with a negative inductor.

7. The metamaterial of claim 1, wherein the non-Foster element comprises one or more of an active circuit and a transistor.

8. A metamaterial exhibiting an effective relative permittivity below unity over a wide bandwidth without tuning, comprising:

one of a two-dimensional and a three-dimensional arrangement of unit cells forming a metamaterial, wherein each of the unit cells has an electric dipole moment that is produced by one or more of an incident magnetic field and an incident electric field; and a coupling mechanism coupling one or more of the incident magnetic field and the incident electric field to a device;

wherein the device comprises a non-Foster element that provides the metamaterial with an effective relative permittivity below unity over a bandwidth comprising a plurality of frequencies such that the plurality of frequencies within the bandwidth are simultaneously tuned.

9. The metamaterial of claim 8, wherein the coupling mechanism comprises a pair of parallel plates coupled by one of a rod and a wire.

10. The metamaterial of claim 8, wherein the non-Foster element comprises an arrangement of one or more negative capacitors.

11. The metamaterial of claim 8, wherein the non-Foster element comprises an arrangement of one or more negative inductors.

12. The metamaterial of claim 8, wherein the non-Foster element comprises an arrangement of one or more negative resistors.

13. The metamaterial of claim 8, wherein the non-Foster element comprises one or more of an active circuit and a transistor.

14. A metamaterial simultaneously exhibiting an effective relative permeability and an effective relative permittivity below unity over a wide bandwidth without tuning, comprising:

one of a two-dimensional and a three-dimensional arrangement of unit cells forming a metamaterial, wherein each of the unit cells has a magnetic dipole moment and an electric dipole moment that are produced by one or more of an incident magnetic field and an incident electric field; and a coupling mechanism coupling one or more of the incident magnetic field and the incident electric field to one or more devices;

wherein the one or more devices comprise one or more non-Foster elements that provides the metamaterial with an effective relative permeability and an effective relative permittivity below unity over a bandwidth comprising a plurality of frequencies such that the plurality of frequencies within the bandwidth are simultaneously tuned.

15. The metamaterial of claim 14, wherein the coupling mechanism comprises one or more of a split ring and a pair of parallel plates coupled by one of a rod and a wire.

16. The metamaterial of claim 14, wherein a non-Foster element of the one or more non-Foster elements comprises an arrangement of one or more negative capacitors.

17. The metamaterial of claim 14, wherein a non-Foster element of the one or more non-Foster elements comprises an arrangement of one or more negative inductors.

18. The metamaterial of claim 14, wherein a non-Foster element of the one or more non-Foster elements comprises an arrangement of one or more negative resistors.

19. The metamaterial of claim 14, wherein a non-Foster element of the one or more non-Foster elements comprises an arrangement of a negative capacitor in parallel with a negative inductor.

20. The metamaterial of claim 14, wherein a non-Foster element of the one or more non-Foster elements comprises one or more of an active circuit and a transistor.

21. The metamaterial of claim 14, wherein the unit cells are alternately oriented along the x and y axes.

22. The metamaterial of claim 14, wherein the unit cells are alternately oriented along the x, y, and z axes.

* * * * *